US005674361A

United States Patent [19]

Marinack

[11] Patent Number: 5,674,361

[45] Date of Patent: Oct. 7, 1997

[54] APPARATUS FOR ADJUSTING CREPING BLADE LOAD AND MAINTAINING CREPING BLADE ANGLE OF A DOCTOR BLADE

[75] Inventor: Robert J. Marinack, Oshkosh, Wis.

[73] Assignee: James River Corporation of Virginia, Richmond, Va.

[21] Appl. No.: 466,286

[22] Filed: Jun. 6, 1995

Related U.S. Application Data

[60] Division of Ser. No. 134,611, Oct. 12, 1993, Pat. No. 5,489,364, which is a continuation-in-part of Ser. No. 929, 572, Aug. 14, 1992, abandoned.

[51] Int. Cl.[6] ..... B31F 1/14; D21G 3/00

[52] U.S. Cl. ..... 162/111; 162/260; 162/281; 15/256.51; 15/256.53; 101/425; 118/413

[58] Field of Search ..... 162/111, 184, 162/260, 281; 15/256.51, 256.53; 101/425; 118/413

[56] References Cited

U.S. PATENT DOCUMENTS

| | | | |
|---|---|---|---|
| 2,566,811 | 9/1951 | Stevenson | 100/174 |
| 3,361,059 | 1/1968 | Klingler | 15/256.51 |
| 4,192,709 | 3/1980 | Dunlap | 162/111 |
| 4,281,434 | 8/1981 | Sullivan | 15/256.51 |
| 4,367,120 | 1/1983 | Hendrikz | 162/281 |
| 4,568,174 | 2/1986 | Stange | 355/15 |
| 4,633,999 | 1/1987 | Perneczky | 198/499 |
| 4,665,859 | 5/1987 | Dunlap et al. | 118/126 |
| 4,738,877 | 4/1988 | Krautzberger | 417/356 |
| 4,789,432 | 12/1988 | Goodnow et al. | 162/281 |
| 4,906,335 | 3/1990 | Goodnow et al. | 162/111 |
| 4,919,756 | 4/1990 | Sawdai | 162/111 |
| 5,403,446 | 4/1995 | Trelsmo et al. | 162/281 |
| 5,507,917 | 4/1996 | Didier et al. | 162/281 |

*Primary Examiner*—Donald E. Czaja
*Assistant Examiner*—Dean T. Nguyen
*Attorney, Agent, or Firm*—Birch, Stewart, Kolasch & Birch, LLP

[57] ABSTRACT

A creping system includes a Yankee dryer rotatable about its axis, a blade support mechanism which includes (a) a pair of guide rails, (b) a fixed attitude linear bearing engaging and translatable along each of the guide rails, each fixed attitude linear bearing being mounted on a block and (c) a combination linear-rotary bearing being carried by each block, the axis of each combination linear-rotary bearing being parallel to the generators of the surface of the Yankee dryer and collinear with the axis of the other combination linear-rotary bearing. A stub shaft engages each combination linear-rotary bearing, each stub shaft being translatable along, and rotatable about, the axis of its respective combination linear-rotary bearing. A blade holder is mounted between the stub shafts, and a blade mounted on the blade holder for engagement with the surface of the Yankee dryer. The blade support mechanism allows the creping angle of the blade to be adjusted and maintained within a desired range by allowing adjustment of the creping blade angle to compensate for changes in creping angle due to flexure of the blade and flank wear on the blade. This adjustment is permitted while allowing the blade holder to be (a) translated in a direction parallel to the generators of the surface of the Yankee dryer, (b) rotated about the axis of the stub shafts; and (c) urged inwardly toward, or outwardly away from, the surface of the Yankee dryer.

12 Claims, 8 Drawing Sheets

EFFECT OF INCREASING CREPING PRESSURE WITHOUT ADJUSTING CREPING ANGLE-- INCIPIENT FAILURE, SHEET IS ALMOST SPLITTING AND PASSING UNDER BLADE

FAILURE OF CREPING BLADE-- DUE TO INCREASED PRESSURE WITHOUT CORRECTION OF CREPING ANGLE

APPARATUS FOR ADJUSTING CREPING BLADE LOAD AND MAINTAINING CREPING BLADE ANGLE OF A DOCTOR BLADE

CROSS-REFERENCE TO RELATED APPLICATIONS

This application is a divisional application of application Ser. No. 08/134,611, filed on Oct. 12, 1993 now U.S. Pat. No. 5,489,364 which is a continuation-in-part of Ser. No. 07/929,572, filed on Aug. 14, 1992, now abandoned, the entire contents of which are hereby incorporated by reference.

BACKGROUND OF THE INVENTION

1. Field of the Invention

The present invention is directed to an apparatus for adjusting the pressure of a doctor blade against a surface while maintaining a predetermined angle of the doctor blade relative to the surface engaged by the doctor blade over a predetermined period of time.

2. Description of Background Art

Hithertofore, adjustment mechanisms have been provided for adjusting the angular relationship of a doctor blade or a creping blade relative to a surface to which the blade is disposed. Typically, a creping blade is disposed adjacent to a Yankee dryer for removing a tissue web or a paper web from the Yankee dryer. The angular relationship of the creping blade relative to the Yankee dryer may be controlled by a plurality of various levers or fluid operated bags may be utilized to adjust the angular relationship of the creping blade relative to a Yankee drum.

Once adjustments are made, the blade normally remains at the predetermined preset angle, except for the change caused by wear, until the blade is replaced.

SUMMARY OF THE INVENTION

The present invention provides a pressure adjustment member for adjusting the pressure and a biasing member operatively connected to a doctor blade for adjusting the angle of the doctor blade relative to a surface engaged by the doctor blade. A control means is provided for controlling the adjustment member and the biasing member for controlling the pressure supplied to a bearing for maintaining the predetermined angle of the doctor blade over a predetermined period of time.

The creping system of the present invention comprises a Yankee dryer rotatable about its axis, a blade engageable to the surface of said Yankee, the blade is mounted on a blade holder having a pair of colinear stub shafts, one stub shaft being attached to each end of the blade holder, the axis of the stub shafts being parallel to the axis of rotation of the Yankee. Each stub shaft engages a combination linear-rotary bearing allowing the blade to be translated in a direction parallel to the generators of the surface of the Yankee as well as to be rotated about the axis of the stub shafts. Each combination linear-rotary bearing is carried on a block engaging a fixed-attitude-linear bearing translatable along a guide rail having a substantial component perpendicular to the surface of the Yankee, and means for oscillating the blade along a path parallel to the generators of the surface of the Yankee, means for angularly adjusting the attitude of the blade holder relative to the surface of the Yankee and means for translating the blocks along with guide rails.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
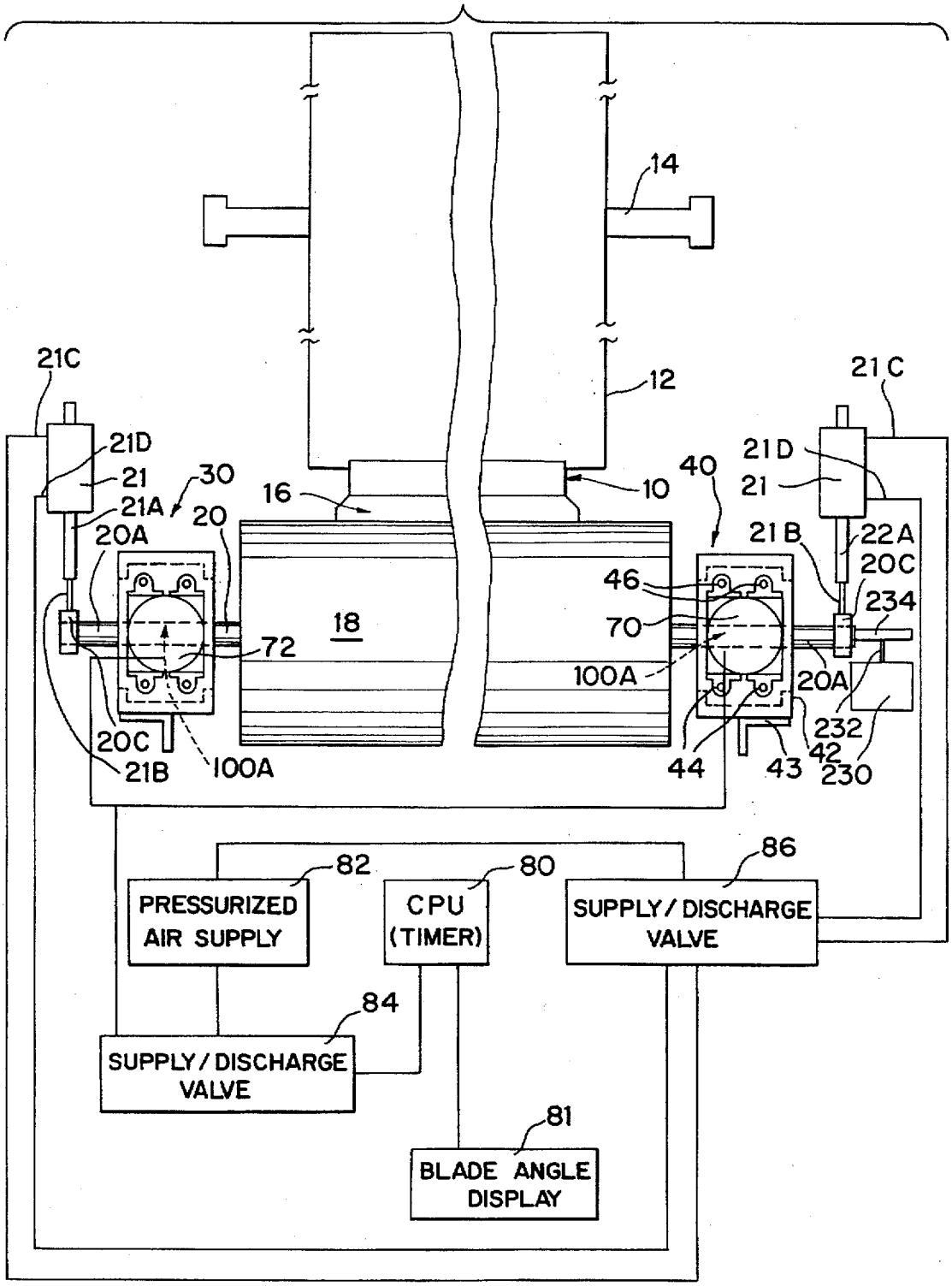
FIG. 1 is a schematic view illustrating an apparatus for adjusting the pressure of a doctor blade against a Yankee dryer with the control system illustrated in block diagram.

As illustrated in FIGS. 1–4, an apparatus for adjusting the pressure of a doctor blade 10 relative to a Yankee dryer 12 is set forth. The Yankee dryer 12 is illustrated in broken lines to represent the fact that the Yankee dryer is an extremely large dryer utilized in tissue making and papermaking to supply heat to the web of tissue or paper during a final forming stage of the tissue or paper. An axle 14 is provided for mounting the Yankee dryer 12 for rotation. The doctor blade 10 is disposed adjacent to the Yankee dryer 12 to engage the outer surface 12A for creping the tissue or paper from the Yankee dryer 12 as the Yankee dryer 12 rotates.

The doctor blade 10 is secured in a holder 16 which engages the blade to the surface of the Yankee dryer 12. In addition, a blade holder assembly 18 is provided for mounting the blade holder 16. The blade holder assembly 18 includes an axle 20 which is provided to permit the blade holder assembly 18 to be rotated to a limited extent for engaging the doctor blade 10 on the Yankee dryer 12. Axle 20 includes stub shafts 20A at each end. Blade load cylinders 21 are mounted pivotally upon the machine frame (not illustrated) and are provided adjacent to each end of the blade holder assembly 18. The blade load cylinders 21 are operatively connected to the axle 20 to allow the blade holder assembly 18 to be rotated about the axis of the axle 20. Blade load cylinders 21 are free both to rotate about an axis which is substantially parallel to the axis of Yankee 12 as well as to oscillate laterally with blade holder assembly 18.

Each blade load cylinder 21 includes a rod 21A operatively mounted within the blade load cylinder 21 for reciprocal movement. A connector member 21B is affixed to one end of the rod 21A. Each connector member 21B is secured to a load arm 20C operatively mounted on a stub shaft 20A of the axle 20. Each blade load cylinder 21 is supplied with a source of pressurized air or other hydraulic fluid through air conduits 21C, 21D. Supplying pressurized air through the conduit 21C while exhausting pressurized air from the conduit 21D will impart movement to a piston disposed within the blade load cylinder 21 for imparting movement to the load arm 20C. Similarly, by supplying pressurized air to the conduit 21D while exhausting pressurized air from the conduit 21C will retract the piston disposed within the blade load cylinder 21, thus imparting an opposite movement to the load arm 20C. Load arms 20C may be splined to stub shafts 20A to enable axle 20 to be rotated about its axis while permitting lateral oscillation of the axle 20.

Bearing assemblies 30 are provided adjacent to each stub shaft 20A of the axle 20 of the blade holder assembly 18. Each bearing assembly 30 includes a housing box frame 42 which is secured to a support member flange 43. The support member flange 43 is mounted to permit the box frame housing 42 to be securely mounted to prevent movement of the box frame housing 42 relative to the Yankee dryer 12. The box frame housing 42 may be constructed from two channel irons 142, 146, one disposed on the top and one disposed on the bottom. Mounting blocks 144, 148 may be secured to the channel irons 142, 146 for securing the channel irons 142, 146 relative to each other and for mounting guide members 44, 46 relative thereto. The guide members 44, 46 extend in a direction having a substantial radial component relative to the surface 12A of the Yankee dryer 12 so that the blade 10 may be urged into engagement therewith while maintaining the blade 10 parallel to the generators of the surface 12A of the Yankee dryer 12 by moving the bearing assemblies 30 along the guide members 44, 46.

Each bearing assembly 30 comprises a bearing block 50 having a combination linear-rotary bearing 100A mounted thereon for permitting axial movement and rotational movement of the shaft 20. In addition, linear bearing members 51, 52 mounted on bearing block 50 encompass guide members 46, 44 which are operatively disposed within linear bearings 51, 52 to permit movement of bearing assembly 30 and blade holder 18 inwardly and outwardly relative to the Yankee dryer 12. Each stub shaft 20A of the axle 20 of the blade holder assembly 18 is operatively disposed through the combination linear-rotary bearing 100A in the bearing block 50 for permitting axial movement and rotational movement of the axle 20. Axial movement of the stub shafts 20A and the axle 20 permits the blade 10 to be oscillated laterally while remaining in engagement with the surface 12A of the Yankee dryer 12. Each load arm 20C is operatively connected to a stub shaft 20A of the axle 20 with enough clearance to permit axial movement of the axle 20. Each connector member 21B is affixed to the load arm 20C. As explained hereinabove, each connector member 21B is affixed to the rod 21A which is operatively connected to the blade load cylinder 21.

Stops 62 are affixed to the guide members 46, 44 to prevent portions of the blade holder assembly 18 other than the blade 10 from being moved into engagement with the Yankee dryer 12. In addition, a biasing member or air bag 70 is provided for applying a force to the bearing block 50 to impart movement to the bearing block 50 to travel along the substantially linear direction defined by the guide members 44, 46.

As illustrated in FIG. 1, a control system is provided for controlling the actuation of the various elements of the present invention. The control system includes a central processing unit (CPU) 80 with a timer mechanism disposed therein. The timer mechanism permits the present invention to be periodically adjusted to control the predetermined angle of the doctor blade relative to the Yankee dryer over a predetermined period of time. In addition, as is conventional, means are provided for imparting axial movement to the axle 20. The axial movement imparted to the axle 20 oscillates the blade holder assembly 18 to cause the doctor blade 10 to oscillate laterally relative to the Yankee dryer 12, thus alleviating wear streaking often caused by uneven blade wear. A blade angle display 81 is provided for displaying the creping angle of the doctor blade relative to the Yankee dryer 12.

A pressurized air supply 82 is in communication with a supply/discharge valve 84, 86. The supply/discharge valve 84 is in communication with each biasing member or air bag 70 operatively connected to the bearing block 50 which contains the stub shaft 20A of the axle 20. The CPU 80 and the timer control the movement of the supply/discharge valve 84 for supplying pressurized air or exhausting pressurized air from the biasing members or air bags 70. In this way, when pressurized, the biasing members or air bags 70 can exert a force on the bearing blocks 50 to permit the linear bearings 52 to move along guide members 44, 46 thereby imparting movement to the blade holder assembly along the substantially linear path defined by the guide members 44, 46. This linear movement causes a counterclockwise rotation (FIG. 2) of the blade 10 tip such that the blade angle (shown as 18° in FIG. 5) becomes smaller. Conversely, exhaust of pressurized air from biasing members or air bags 70 permit bearing assemblies 30 to move in an opposite direction along the path defined by the guide members 44, 46. This linear motion causes a clockwise rotation (FIG. 2) of the blade 10 tip such that the blade angle (shown as 18° in FIG. 5) becomes larger.

The supply/discharge valve 86 is operatively connected to the conduits 21C, 21D which are in communication with the blade load cylinder 21. The CPU 80 controls the operation of supply/discharge valve 86. In this way, movement is imparted to the load arms 20C to adjust the pressure of the doctor blade 10 relative to the Yankee dryer 12.

In addition, the motor 230 imparts rotation to the shaft 232 for rotating the cam 234. The rotation of the cam 234 imparts lateral movement to the shaft 20 for oscillating the doctor blade 10 relative to the Yankee dryer 12.

Figure 2:
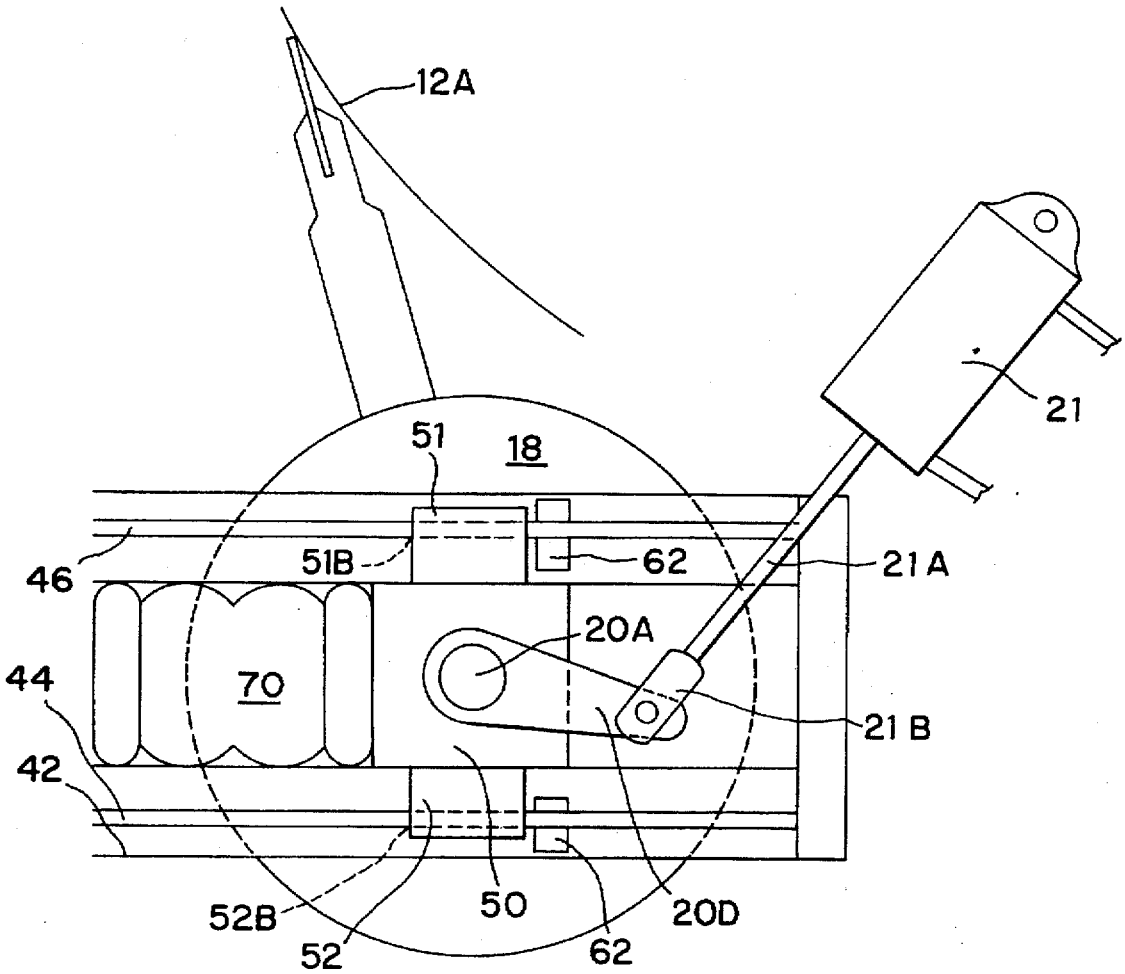
FIG. 2 is an enlarged elevational view of one of the bearings utilized to support one end of the doctor blade according to the present invention.
Figure 2A:
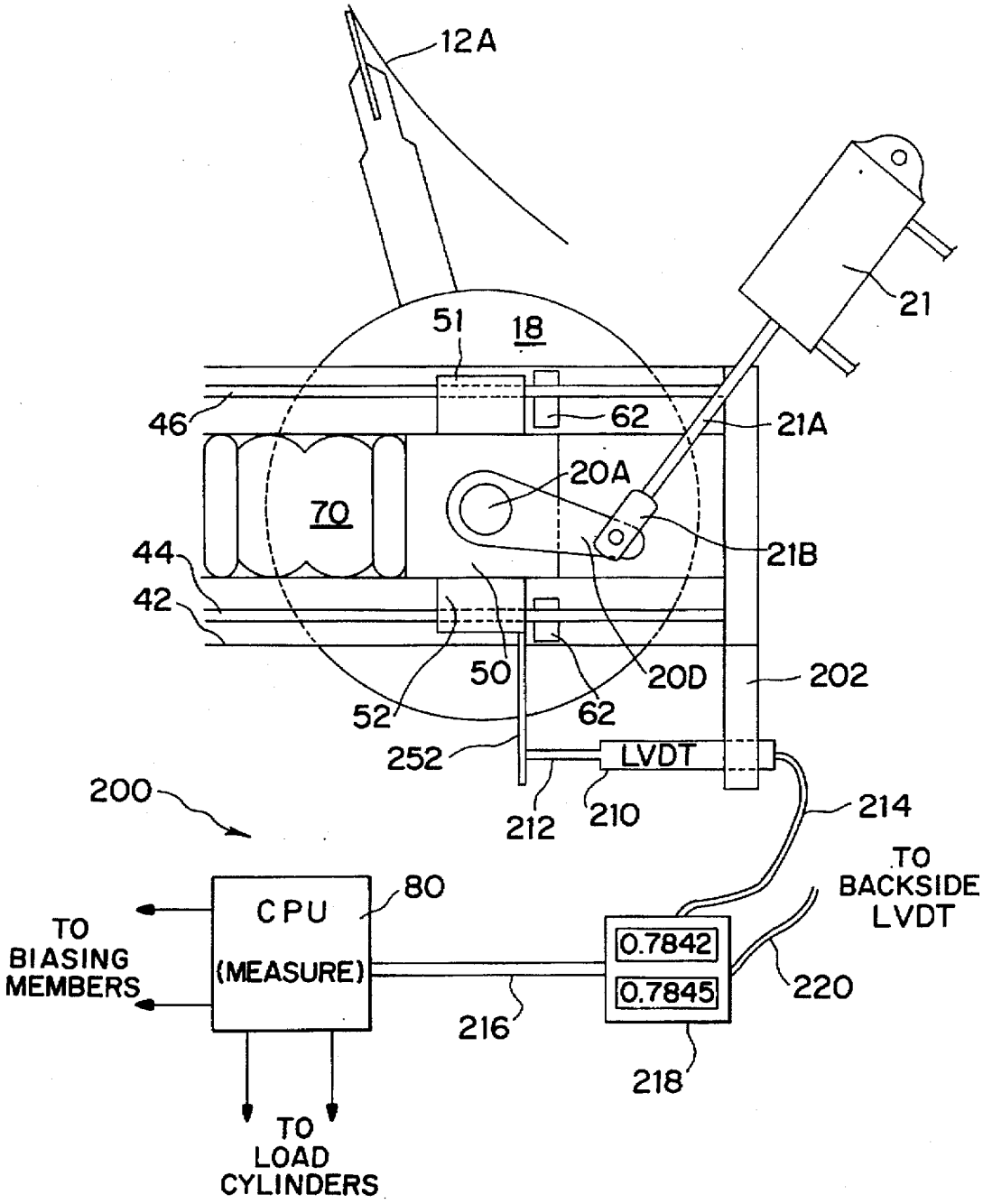
FIG. 2A is an enlarged elevational view of one of the bearings utilized to support one end of the doctor blade and further illustrating a control unit for the adjusting apparatus.
Figure 3:
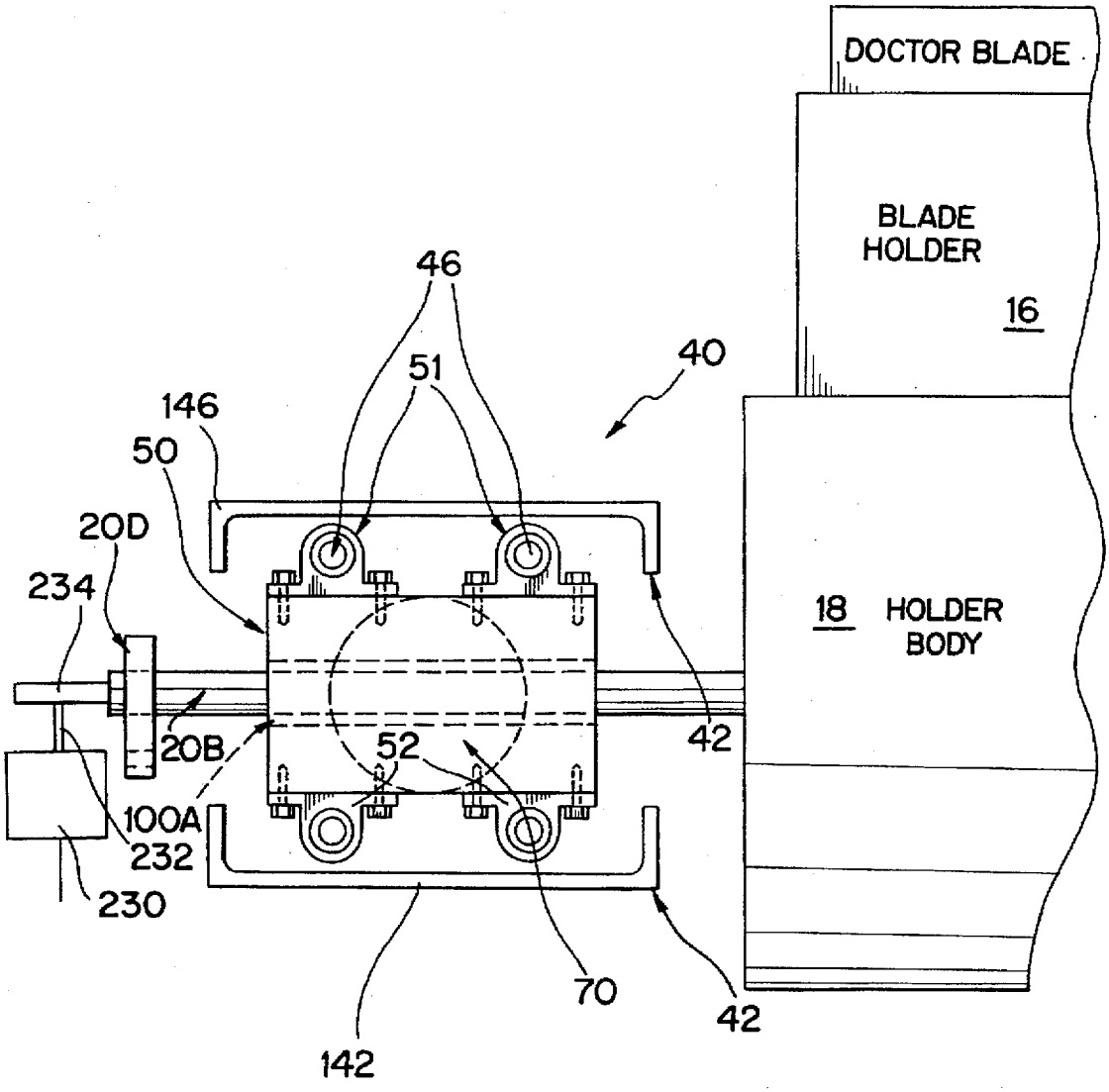
FIG. 3 is an end view of the bearing illustrated in FIG. 2 showing the bearing guide members mounted for guiding the movement of the bearing block.
Figure 4:
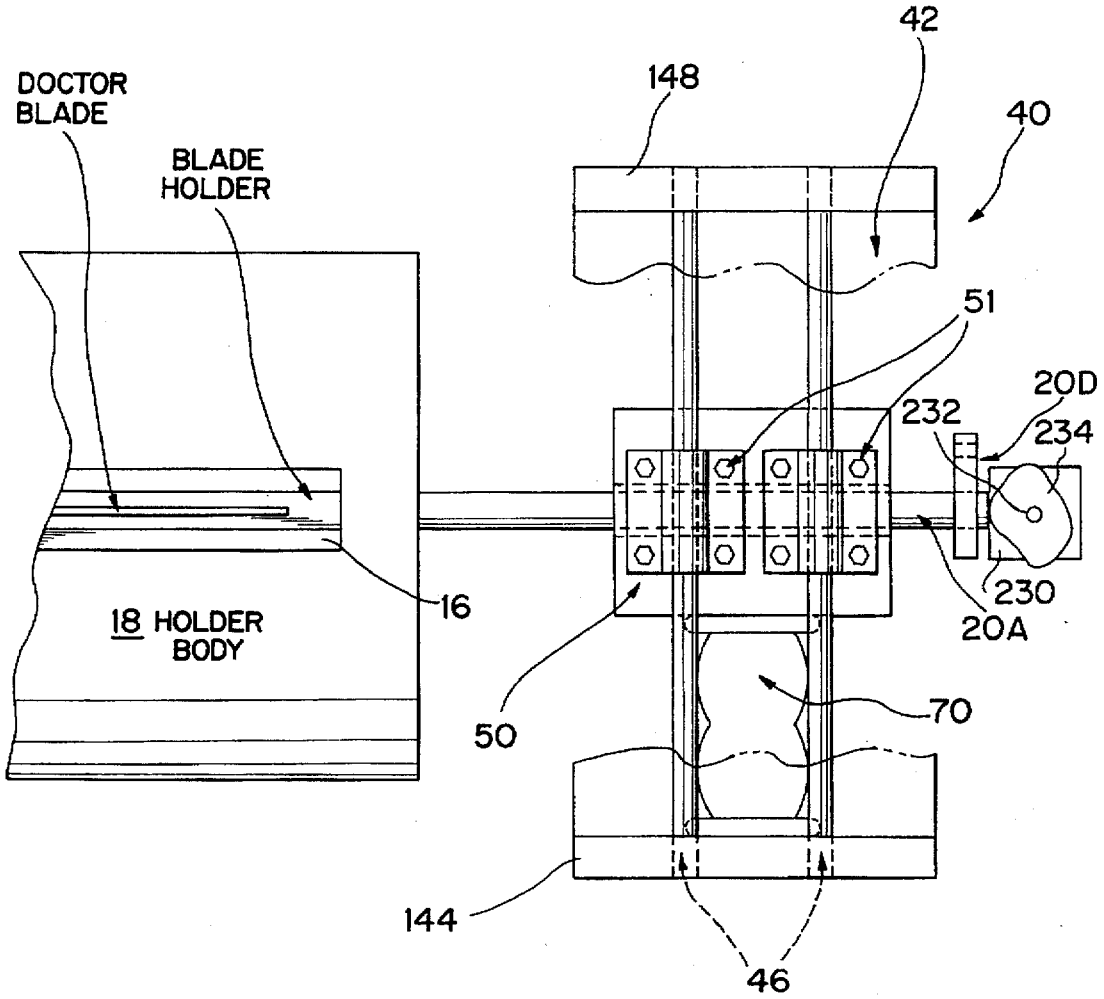
FIG. 4 is a top plan view with a portion of the support broken away to illustrate the configuration of the bearing guide members and the bearing blocks positioned adjacent to the biasing air bag of the present invention.

FIG. 2A illustrates a control unit 200 for the apparatus for adjusting the pressure on the doctor blade 10 mounted on the blade holder 16. Like numerals, as set forth in FIG. 2, are utilized to identify a number of the elements set forth in FIG. 2A and will not be further described hereinafter.

For each blade load, a combination of angular orientation and position can be found for maintaining the blade creping angle at its desired value. Thus, a table may be generated empirically, for each type of blade, setting forth those positions of bearing block 50 and angular orientations of blade holder assembly 18 producing the desired blade angle. For convenience, we refer to these relationships as the "set-up curve." Thus, to maintain the blade angle at the desired value as the blade wears, the orientation and position of blade holder 18 is adjusted to increase the blade load while compensating for the increased deflection of blade 10 due to that increased blade load so as to maintain the desired blade angle. The position of bearing blocks 50 is varied by pressure supplied to air bags 70 to move bearing blocks 50 and blade holder 18 toward the surface of the Yankee dryer 12, while pressure supplied to cylinders 21 will rotate blade 10 into engagement with the surface 12A of the Yankee dryer 12. However, if one of the guide members 44 binds within its associated linear bearing 52, or some other malfunction occurs, the given air pressure in one of the biasing members or air bags 70 may position the holder in an incorrect position on one side as compared to the other side of the blade holder 16. This incorrect adjustment of the blade holder 16 is, of course, highly undesirable.

Control units 200 are provided on each side of the blade holder 16. Each control unit 200 includes a linear variable differential transmitter 210 operatively mounted relative to an end wall member 202. Each linear variable differential transmitter 210 includes a sensing member 212 which projects from the linear variable differential transmitter 210 and engages an abutting surface 252 affixed to the bottom bearing members 52. The position of the abutting surface 252 relative to the end wall member 202 is sensed and transmitted to the central processing unit 80 through cables 214 and 216. A display readout unit 218 is provided in the operative connection with the cable 214 for permitting an individual to visually determine the readings generated by the linear differential transmitter 210. A cable 220 is connected to the display readout unit 218 and to the backside of the linear variable differential transmitter 210.

To obtain the correct position of the bearing blocks 50 as specified by the set-up curve, the pressure exerted through biasing members or air bags 70 on the bearing blocks 50 is adjusted to move the bearing blocks 50 into the correct position as indicated by the linear variable differential transmitter reading. The linear variable differential transmitter reading is used as controls at the beginning of loading, to supply an initial reading of the position of each bearing block 50 to the CPU 80. This signal serves as the set point for the initial position of the linear variable differential transmitter 210 corresponding to the load cylinder pressure form the pregenerated curve. The front linear variable differential transmitter loop signals the biasing member or air bag 70 to adjust the doctor blade holder 16 to the set point. The back side linear variable differential transmitter loop uses the cascade process variable from the front side linear variable differential transmitter loop to signal biasing members or air bags 70 to adjust the doctor blade holder 16 to the set point to maintain the blade holder assembly 18 in alignment. CPU 80 drives the set point of the front and rear linear variable differential transmitter loops to change the angle of the doctor blade holder 16. The load cylinder and the biasing members or air bags 70 would then correct the load and the position of the doctor blade holder 16 to match the new set point of the linear variable differential transmitter.

The control unit 200 not only maintains the doctor blade holder 16 in proper alignment, but also maintains the alignment in the case of air or hydraulic failure. The linear variable differential transmitters would monitor each other such that if a large discrepancy occurs between the two biasing members, the biasing would unload against the mechanical stops 62 to prevent a malfunction of the adjusting apparatus.

Three separate degrees of freedom of motion of the blade holder 16 are permitted according to the present invention. The blade holder 16 may be oscillated along a line parallel to the generators of the surface of the Yankee dryer 12 to prevent uneven blade wear. In addition, the blade holder 16 can be rotated against the surface Yankee dryer 12A about an axis which is parallel to the axis of the Yankee dryer 12. Further, the blade holder 16 can be moved inwardly and outwardly relative to the axis of the Yankee dryer 12.

The combination of the second two movements provides a new effect wherein the creping angle can be decoupled from the creping blade bearing pressure.

Figure 5:
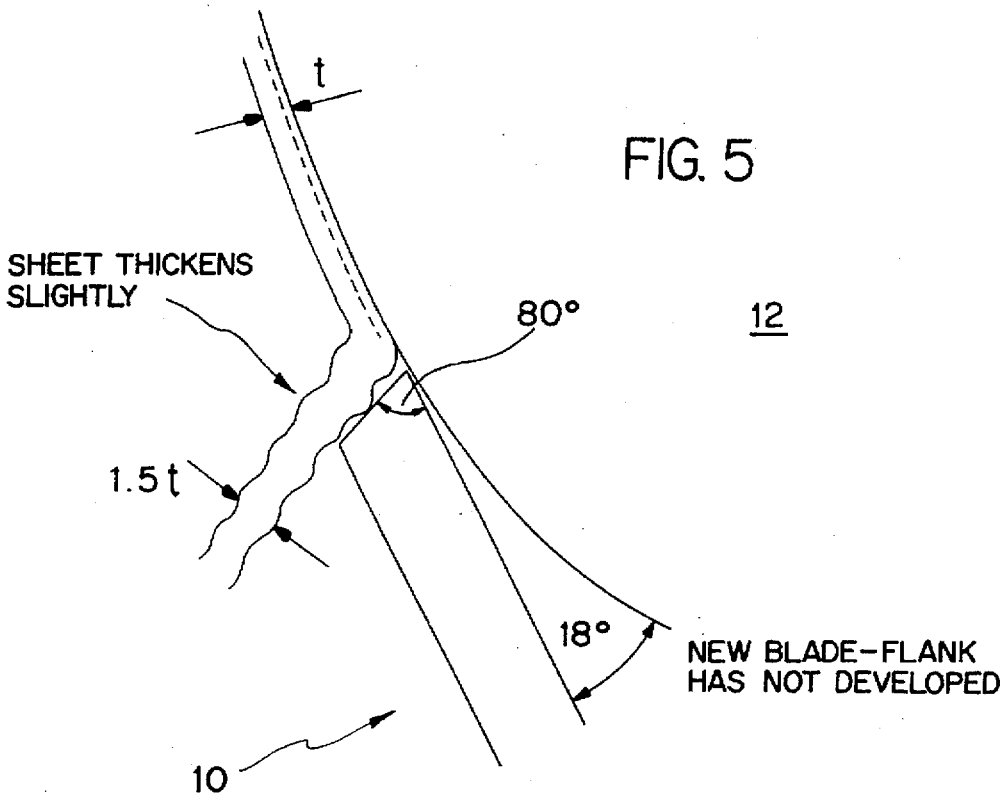
FIG. 5 is an enlarged schematic view illustrating a new doctor blade disposed adjacent to a Yankee dryer wherein a flank portion has not yet developed in the bevel section of the doctor blade.

The present invention maintains constant creping angle, definable as the angle between the bevel on the blade, see FIG. 5, and the tangent to the Yankee cylinder, to minimize changes in sheet properties as the blade wears while prolonging blade life. The total load or lineal pressure, in pounds per lineal inch (pli), on the blade may be varied while maintaining constant creping angle. Thus, when the flank or land on the blade is very narrow at the beginning of a run, only a very light pli load is applied to the blade. Empirically, a bearing pressure of about 1,000 psi, calculated based on dividing total load (pli) by the actual width of the flank to yield psi, is required to prevent the sheet from passing under the blade rather than being creped off the cylinder as desired, for example. In prior art operations, the initial total load or lineal pressure on the blade has been much higher leading to premature blade wear. If the total load on the blade is set to yield a bearing pressure of 1,000 psi at the beginning of the run, as the flank wears, the bearing pressure will quickly fall below 1,000 psi leading to blade "float." Thus, the present invention maintains the bearing pressure only slightly above 1,000 psi by increasing the total load or lineal pressure to compensate for flank wear throughout the life of the blade.

FIGS. 5–9 illustrate graphically the effects of blade wear if blade attitude is not controlled. The present invention maintains a constant creping angle, called "impact angle" in U.S. Pat. No. 4,919,756, as the doctor blade is progressively used.

Figure 6:
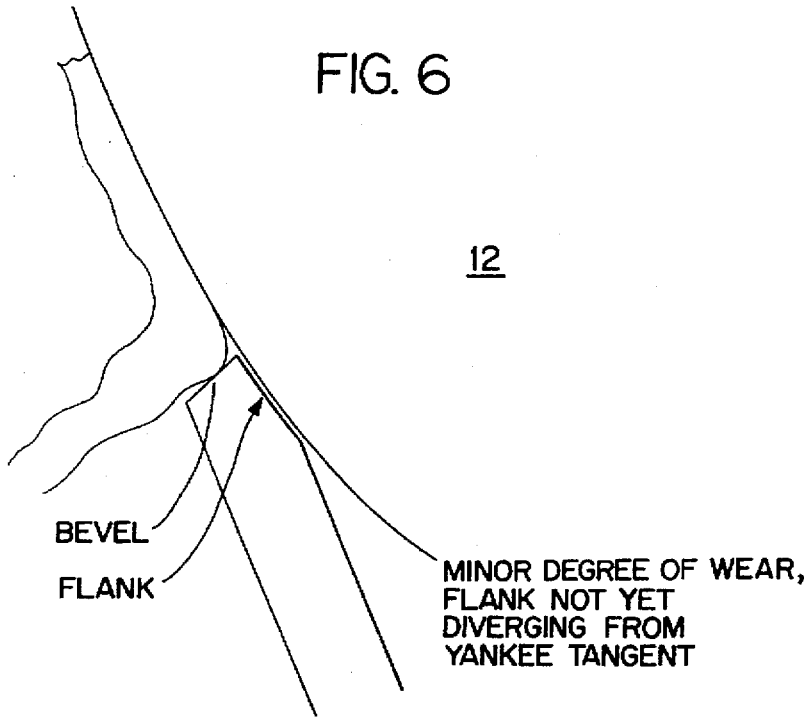
FIG. 6 is an enlarged schematic view illustrating a doctor blade having a bevel portion wherein minor wear of the doctor blade has produced a flank portion adjacent to the bevel.

The creping process of the present invention begins by applying a load on the creping blade of about 3–5 pounds per lineal inch as shown in FIG. 5. Because the leading edge of the creping blade can be visualized as having essentially an infinite radius of curvature, the bearing pressure is quite high in this case, and the blade remains in intimate contact with the Yankee dryer 12. Thus, the bearing pressure is well over a thousand pounds per square inch because of the small contact area between the blade and the Yankee dryer 12. As the blade wears, a flank or land tends to form downstream of the leading edge of the blade. This flank increases greatly the contact area between the blade and the Yankee dryer 12 as shown in FIG. 6. Therefore, the bearing pressure is decreased.

Figure 7:
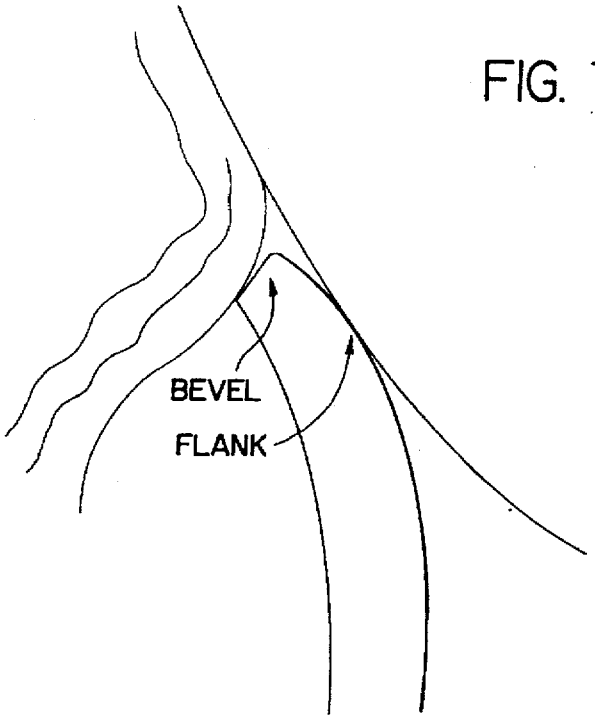
FIG. 7 is an enlarged schematic view wherein the effect of increasing creping pressure without adjusting the creping angle the incipient failure sheet is in a position to split and press under the doctor blade.
Figure 8:
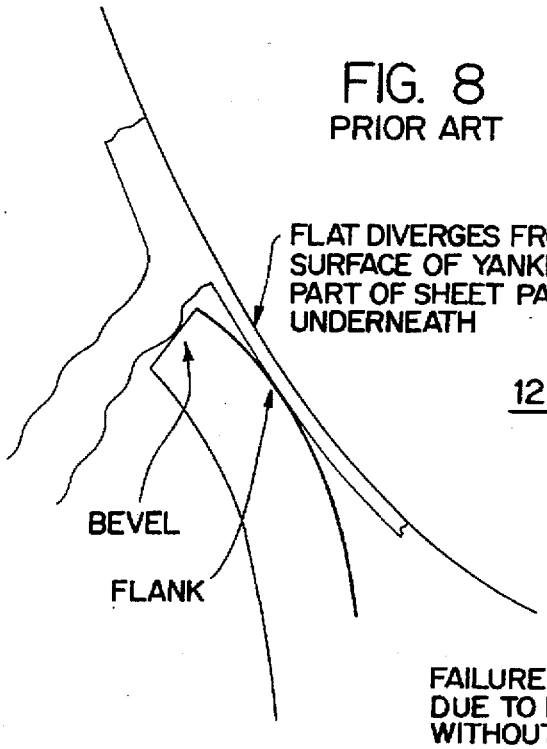
FIG. 8 PRIOR ART
FIG. 8 is an enlarged schematic view of the prior art wherein the doctor blade permits the sheet to separate with a portion of the sheet passing underneath the doctor blade.

In the prior art, the practice has been to begin operation with a much higher lineal pressure so that even after the blade wears, the bearing pressure between the blade and the Yankee dryer will still remain quite high. However, when the bearing pressure reaches too low a level, in the neighborhood of around 1,000 pounds per square inch, the blade tends to "float" as the pressure is no longer sufficient to scrape the sheet, i.e., the dried web, from the Yankee dryer. If the lineal pressure is increased without maintaining a constant creping angle, the condition as shown in FIG. 7 begins to develop where the flank is actually presented to the sheet. This condition rapidly deteriorates to that shown., in FIG. 8 wherein the blade no longer scrapes the sheet from the Yankee dryer but splits it, or the sheet may pass entirely under the blade (not shown).

Figure 9:
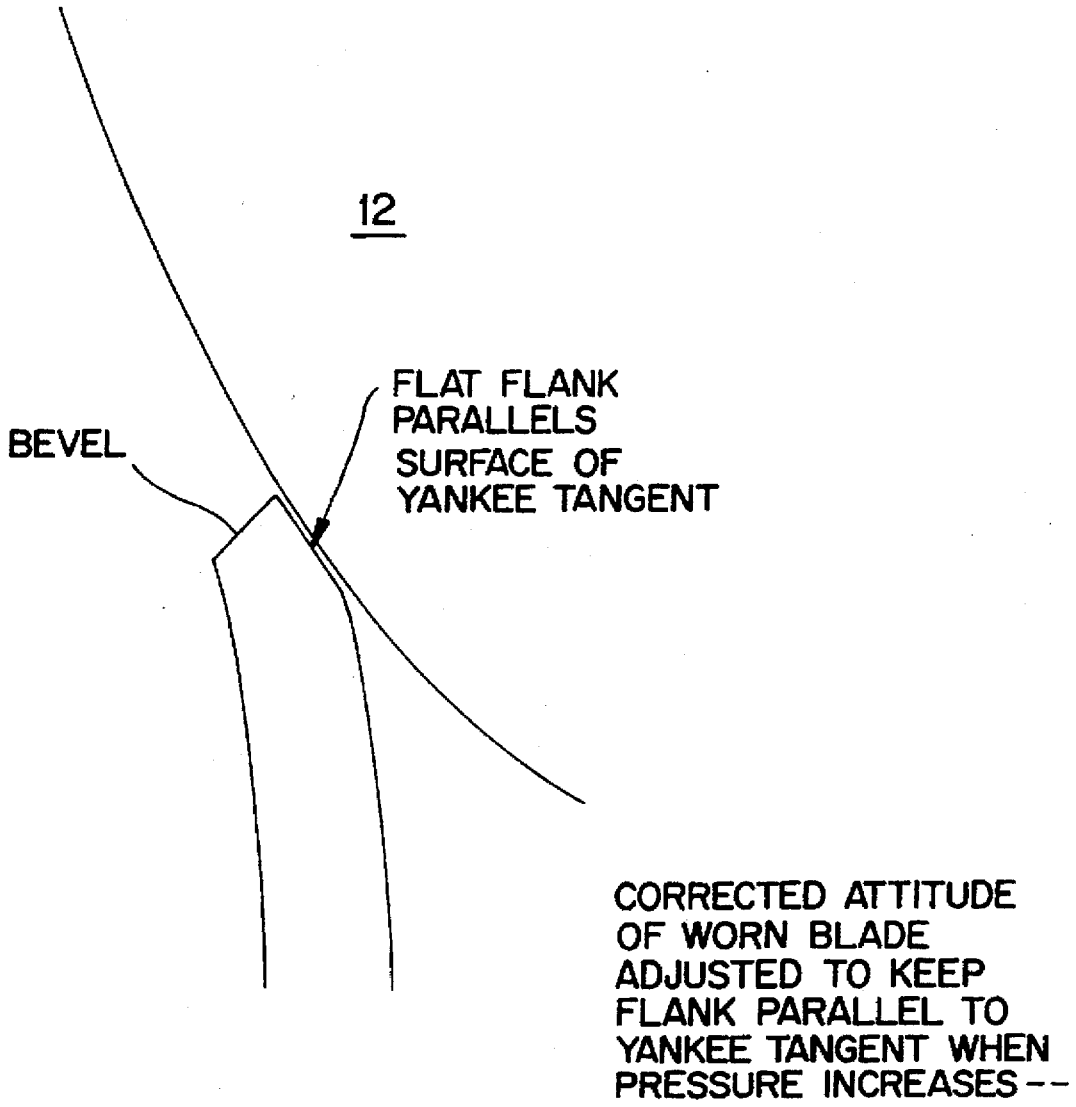
FIG. 9 is an enlarged schematic view wherein the attitude of a worn blade is adjusted to maintain the flank portion parallel to the Yankee tangent when pressure increases.

As illustrated in FIG. 9, the attitude of the blade is adjusted to maintain a constant creping angle and maintain the flank parallel to the Yankee tangent. The sheet is then unable to pass under the blade and creping can continue. The lineal pressure on the blade is increased to compensate for the increased flank area while the attitude of the blade holder is adjusted to maintain a constant creping angle.

To utilize the apparatus according to the present invention, initially, an analysis is conducted on the machine of the unit to determine the minimum load requirement to start the creping process. This includes the pressure required to raise the holder plus the pressure to control the blade against the Yankee dryer 12 plus sufficient pressure to scrape the web off the Yankee dryer 12. A second number is needed, namely, the maximum load wherein the hardware is capable of functioning to exert a pressure on the doctor blade relative to the Yankee dryer 12. A third piece of data is required. A control curve is needed for the type of blade and the desired blade "stick-out" from the holder. Different levels of biasing pressure will be required depending on the yield of the blade under increasing pressure. After the proper calculations are entered into the central processing unit 80, the blade is loaded and three things will happen:

1. The minimum load will be applied to the doctor blade to the Yankee dryer 12. For purposes of discussion, air pressure will be provided to give a 25° blade angle with respect to the Yankee dryer 12.
2. For a period of time, the condition set forth in Paragraph 1 will continue. After a sufficient amount of material is worn off the corner of the doctor blade, wherein failure is within 15 to 30 minutes away, the timer within the central processing unit 80 will begin to add air pressure to the blade load cylinders 21 to adjust the pressure of the doctor blade 10 relative to the Yankee dryer 12. This increase in load, if not compensated for, would bend the blade resulting in a new creping angle, as shown in FIG. 7. To avoid this angle change, at the same time, the biasing members or air bags 70 will be reduced in pressure so that the blade angle is maintained. This process will continue until the maximum load of the system is reached. The system may be started at a very low blade angle, for example, 10° and gradually be brought to the running angle, for example, 25° while the web is being threaded, namely, 5 to 10 minutes. This may allow a smaller minimum load which would be a more preferred way to initiate the starting of a creping blade. The advantage would be less stripping of the dryer coating and less dryer wear both of which are desirable.

Initially, a determination is made as to the required minimum load for satisfactory creping with a new creping doctor blade, using sufficient pressure in the biasing members or air bags 70 to keep the blade holder 16 against the stops 62. The stops 62 would be set such that the desired creping angle is obtained at this minimum blade pressure. The air pressure in the blade load cylinders 21 would then be increased to a level of one fifth of the maximum load capability of the doctor blade system, as an example of one method of generating an operating curve. The maximum load of the system will be determined by the manufactures of the creping blade holder 16 and the Yankee dryer 12. Without any change in the air pressure in the biasing members or air bags 70, the holder 16 will move away from the Yankee dryer 12 changing the creping blade angle. At this point the biasing air will be increased to move the holder back toward the Yankee dryer 12 until the original creping angle is obtained. In addition, the motor 230 will rotate the shaft 232 for imparting rotation to the cam 234. The cam 234 will impart axial movement to the shaft 20 for oscillating the doctor blade 10 relative to the Yankee dryer 12.

Because of the flex in the blade, the position of the holder 16 will not be the same as in the initial setting. The holder 16 position will be slightly further away from the Yankee dryer 12 to compensate for the increased bend in the blade. This procedure will continue at two fifths, three fifths, four fifths, and maximum load, each time noting the amount of biasing pressure needed to offset the increased loading while maintaining the desired creping angle. Once these values are determined a curve can be generated of creping blade load versus biasing load. Note that this curve is only valid for this particular type of blade and its position in the holder 16 with reference to its protrusion. Different protrusions and blades of different material, makeup, and/or thickness will generate other curves.

Once a curve is generated the information can be fed into the CPU 80 of the paper machine. A program will start a creping blade at a very low load and finish at a maximum load while maintaining creping angle. This approach will not damage Yankee dryer coatings or the dryer surface. A decreased frequency of Yankee grinds and an improvement in blade life and product uniformity will be realized.

An average width of flank wear can be determined by measuring a number of blades at various stages in their life. Once the rate of wear is determined, the wear information can be fed into a CAD type system. The position of the holder can be adjusted to compensate for flank wear. The shape of the crepe blade load versus biasing load curve can then be adjusted to account for slight difference in creping angle.

Another benefit of this system is that the creping angle can be changed very easily. This may be very desirable on machines that run multiple grades of product. Desirable product attributes will be achieved with different creping angles for each grade of product. A different creping angle may also be desirable for different adhesion systems within the same grade of product.

To further enhance the system benefits of reduced coating stripping and increased Yankee dryer 12 life, a program will start a new blade at a very low creping blade angle and gradually increase to the desired angle while the sheet threading process is in progress.

The present invention provides an improved doctor blade life wherein the magnitude will depend on current or modified load capability and current load. One and one-half times the current life should be easily achievable. In addition, longer times between the Yankee grinds will be achieved by the present invention. The apparatus according to the present invention exerts no pressure on the blade other than pressure which is necessary. Current systems exert an infinite load initially and maintain a higher than required load throughout the life of each blade.

The crepe angle can be changed at will depending on the numbers supplied to the central processing unit. If a machine runs more than one grade, each grade may benefit using unique creping angles. Current systems cannot achieve this result. In addition, corrections may be made to the doctor blade angle very quickly. If a nozzle plug or a wet streak causes unusual wear, an operator may turn up the pressure to compensate without changing the crepe angle. This permits extended life for the doctor blade while this problem is being corrected.

Although the present invention has been described with reference to a combination linear-rotary bearing 100A and linear bearings 51 and 52, it is contemplated in the present invention to construct the bearing 100A as a linear bearing and the bearings 51, 52 as combination linear-rotary bearings.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A creping system comprising:

(i) a Yankee dryer rotatable about its axis having a first end and a second end;

(ii) a blade support mechanism comprising:

(a) a pair of guide rails positioned adjacent to each end of the Yankee dryer;

(b) a fixed attitude linear bearing engaging and translatable along each of said guide rails, each fixed attitude linear bearing being mounted on a block;

(c) a combination linear-rotary bearing being carried by each said block, the axis of each combination linear-rotary bearing being parallel to the generators of the surface of the Yankee dryer and collinear with the axis of the other combination linear-rotary bearing;

(d) a stub shaft engaging each combination linear-rotary bearing, each stub shaft being translatable along, and rotatable about, the axis of its respective combination linear-rotary bearing;

(e) a blade holder mounted between said stub shafts; and (f) a blade mounted on said blade holder for engagement with the surface of said Yankee dryer, said blade support mechanism capable of adjusting and maintaining said blade at a predetermined creping angle while allowing the blade holder to be:

(1) translated in a direction parallel to the generators of the surface of the Yankee dryer;

(2) rotated about the axis of the stub shafts; and (3) urged inwardly toward, or outwardly away from, the surface of the Yankee dryer.

2. The creping system of claim 1, further comprising means for angularly adjusting the attitude of the blade holder relative to the surface of the Yankee dryer and means for translating the blocks along said guide rails.

3. An apparatus for adjusting the pressure of a doctor blade against a surface while maintaining a predetermined creping angle of the doctor blade relative to a surface engaged by said doctor blade comprising:

(a) a doctor blade having a surface engaging member, a first end and a second end;

(b) a blade holder for mounting said doctor blade relative to a surface engaged by said doctor blade, said blade holder includes a first end and a second end;

(c) a shaft operatively connected to said blade holder for permitting rotation of said doctor blade for adjusting the pressure of the doctor blade relative to a surface engaged by said doctor blade;

(d) bearing means mounted on both said first and second ends of said blade holder, said bearing means includes a first linear bearing and a first linear-rotary bearing mounted on said first end of said blade holder and a second linear bearing and a second linear-rotary bearing mounted on said second end of said blade holder for supporting said blade holder and said doctor blade relative to a surface engaged by said doctor blade;

(e) guide means for guiding the bearing means to travel in a direction toward and away from a surface engaged by said doctor blade;

(f) biasing means for exerting a pressure on said bearing means for imparting movement to said bearing means to travel in a direction toward and away from a surface engaged by said doctor blade for initially establishing said predetermined creping angle of inclination of said doctor blade; and (g) control means for controlling said shaft and said biasing means for controlling and continuously increasing said pressure on said bearing means for maintaining said predetermined creeping angle of said doctor blade over a predetermined period of time against a surface engaged by said doctor blade.

4. The apparatus for adjusting the pressure of a doctor blade according to claim 3, wherein said control means includes a timer for periodically actuating said shaft and said biasing means for controlling said pressure on said bearing means for maintaining said predetermined angle of said doctor blade relative to a surface engaged by said doctor blade.

5. The apparatus for adjusting the pressure of a doctor blade according to claim 3, wherein said guide means includes at least one rod for supporting said linear-rotary bearing to travel in a direction toward and away from a surface engaged by said doctor blade.

6. The apparatus for adjusting the pressure of a doctor blade according to claim 3, wherein said biasing means is an air bag.

7. The apparatus for adjusting the pressure of a doctor blade according to claim 3, wherein said control means is a central processing unit operatively connected to supply/discharge valves for supplying/discharging pressurized air to said shaft and said biasing means.

8. The apparatus for adjusting the pressure of a doctor blade according to claim 3, and further including a linear variable differential transmitter operative connected to said bearing mounted on both said first and second ends of said doctor blade for providing a reading as to the set point of each bearing for permitting adjustment to the biasing means for aligning the doctor blade relative to a surface engaged by said doctor blade.

9. The apparatus for adjusting the pressure of a doctor blade according to claim 8, and further including a read out unit for visually providing an indication of the position of the linear variable differential transmitter relative to the bearing mounted on both said first and second ends of said doctor blade.

10. A creping system for use with a Yankee dryer having a first end and a second end and being rotatable about its axis comprising:

a blade support mechanism comprising:

(a) at least one guide rail being mounted adjacent to each of the first and second ends of said Yankee dryer;

(b) a linear bearing engaging and translatable along said guide rail, each linear bearing being mounted on a block;

(c) a combination linear-rotary bearing being carried by each said block, the axis of each combination linear-rotary bearing being substantially parallel to the generators of the surface of the Yankee dryer and collinear with the axis of the other combination linear-rotary bearing;

(d) a shaft engaging each combination linear-rotary bearing, said shaft being translatable along, and rotatable about, the axis of its respective combination linear-rotary bearing;

(e) a blade holder mounted on said shaft; and (f) a blade mounted on said blade holder for engagement with the surface of said Yankee dryer, said blade support mechanism capable of adjusting and maintaining said blade at a predetermined creping angle while allowing the blade holder to be:
(i) translated in a direction parallel to the generators of the surface of the Yankee dryer;
(ii) rotated about the axis of the shaft; and
(iii) urged inwardly toward, or outwardly away from, the surface of the Yankee dryer.

11. The creping system according to claim 10, wherein said at least one guide rail includes two guide rails for guiding said linear bearing.

12. The creping system according to claim 10, and further comprising means for angularly adjusting the attitude of the blade holder relative to the surface of the Yankee dryer and means for translating the blocks along said guide rails.

* * * * *